United States Patent [19]

Dobry et al.

[11] Patent Number: 4,921,053

[45] Date of Patent: May 1, 1990

[54] VIBRO-ISOLATION OF CONNECTIONS OF STRUCTURAL UNITS OF HAND TOOLS

[75] Inventors: Marian W. Dobry; Czesław Cempel; Wiesław Garbatowski, all of Poznań, Poland

[73] Assignee: Politechnika Poznanska, Poznań, Poland

[21] Appl. No.: 325,194

[22] Filed: Mar. 16, 1989

[30] Foreign Application Priority Data

Mar. 29, 1988 [PL] Poland ..... 271525

[51] Int. Cl.[5] ..... B25F 5/00

[52] U.S. Cl. ..... 173/162.2

[58] Field of Search ..... 173/162.1, 162.2

[56] References Cited

U.S. PATENT DOCUMENTS

| | | | |
|---|---|---|---|
| 2,058,583 | 10/1936 | Forss | 173/162.2 |
| 3,511,137 | 5/1970 | Smith | 173/162.1 |
| 3,968,843 | 7/1976 | Shotwell | 173/162.2 |
| 4,081,038 | 3/1978 | Andersson et al. | 173/162.1 |
| 4,327,807 | 5/1982 | Emonet | 173/162.1 |
| 4,635,732 | 1/1987 | Gotsch et al. | 173/162.1 |
| 4,648,468 | 3/1987 | Honsa | 173/162.2 |
| 4,771,833 | 9/1988 | Honsa | 173/162.2 |

FOREIGN PATENT DOCUMENTS

| | | |
|---|---|---|
| 115085 | 7/1982 | Poland . |
| 118242 | 4/1983 | Poland . |
| 121231 | 10/1983 | Poland . |
| 122381 | 6/1984 | Poland . |
| 128491 | 8/1985 | Poland . |
| 122477 | 12/1985 | Poland . |

OTHER PUBLICATIONS

Bychowskij, Goldsztejn—"Osnowy Konstruriowanije Wibrobezopastnych Wibrobezopastnych Rucznych Maszyn", Moscow, 1982, pp. 177–178.

Atlas Copco—Hand Tools Catalog—Hammer RR D 36.

*Primary Examiner*—Douglas D. Watts

*Assistant Examiner*—Scott A. Smith

*Attorney, Agent, or Firm*—Ladas & Parry

[57] ABSTRACT

Vibro-isolation of connections of structural units of hand tools consisting of a vibro-isolator with a constant reaction force is characterized by that on the side of the body /3/ of the compressed-air engine there is an upper /9/ and lower /10/ elastic guide being the first stage of vibro-isolation in the directions /x/ and /y/ perpendicular to the axis of symmetry of the tool, whereas in the main direction /z/ parallel to the axis of symmetry of the tool vibro-isolation is ensured by an elastic system consisting of a vibro-isolator /1/ with a constant reaction force connected to the body /3/ of the compressed-air engine through a spring washer /2/, whereas on the side of the grip /4/ vibro-isolator /1/ with a constant reaction force is mounted through a spring washer /6/ and sleeve /7/ being at the same time the second stage of vibro-isolation of the grip /14/. Moreover, the second stage of vibro-isolation for the left operator's hand is the grip itself in the form of a spring sleeve /13/ screwed onto the end-portion of the body-housing /8/, whereas vibro-isolation of the supply system is formed of an intermediate sleeve /17/ and a silent-block connection of the supply unit /15/ with the grip /14/.

3 Claims, 1 Drawing Sheet

VIBRO-ISOLATION OF CONNECTIONS OF STRUCTURAL UNITS OF HAND TOOLS

BACKGROUND OF THE INVENTION

This invention relates to vibro-isolation of connections of structural units of hand tools.

The designs of hand tools with pneumatic drive known from the Patent Specifications don't take into account the existance of vibrations of value exceeding the permissible ones in the directions perpendicular to the main axis of symmetry of the tool. Vibro-isolations introduced in those designs are limited to one direction of vibrations only, that is to the direction parallel to the axis of symmetry, in which maximum vibration acceleration levels are observed. This relates to the designs presented in the Polish Patent Specifications Nos. 115085, 118242, or 122477.

So for instance in the Patent Specification No. 122477 there has been presented a pneumatic hammer with a shock absorber. It has at least two bolts and the corresponding springs slidably mounted on the annular barrel extension, a seat, an immovable elastic ring, mounted with the external dimension in the hammer seat and with the internal dimension in the barrel, as well as a flanged sleeve with a barrel slidably mounted in it. Bolts passing through the said elastic ring connect on one side the seat and on the other side the sleeve via nuts, springs and flange of the above mentioned sleeve.

However, such vibro-isolation is not sufficient and does not fulfil the existing vibration standards.

SUMMARY OF THE INVENTION

The invention consists in that on the side of the body of the compressed-air engine there are elastic guides being the first stage of vibro-isolation on the direction x and y lying in a plane perpendicular to the axis of symmetry of the tool, whereas on the main direction z parallel to the axis of symmetry of the tool, vibro-isolation is an elastic system consisting of a vibro-isolator with a constant reaction force connected to the body of the compressed air engine by means of a spring washer. Vibro-isolator with a constant reaction force is mounted on the side of the grip by means of a spring washer and a sleeve, being at the same time the second stage of vibro-isolation of the grip. Moreover, the second stage of vibro-isolation for the left hand of the operator is the grip itself, having the form of an elastic sleeve screwed onto the end portion of the body-housing. Vibro-isolation of the supply system consists of an intermediate sleeve and a slient-block connection of the supply unit with the grip. The upper guide is a silent-block pressed into the seat in the body-housing having, on the side of the body of the compressed air engine, a sleeve made of a material with a small friction coefficient, the lower guide being made of a silent-block, which has on the side of the body of the compressed air engine a sleeve with a hole with internal splines.

Introduction of elastic guides makes possible relative reciprocating or sliding motions of the engine body in the housing, the lower guide acting additionally as a vibro-isolator for limiting the torsional vibration which can be generated by the working compressed air engine. Owing to the described vibro-isolation system a considerable reduction of the vibration levels of grips for the operator's hands for all the three directions of vibration has been obtained.

BRIEF DESCRIPTION OF THE DRAWING

The subject of the invention is presented in the embodiment shown in the drawings, wherein.

DESCRIPTION OF THE PREFERRED EMBODIMENT

Figure 1:
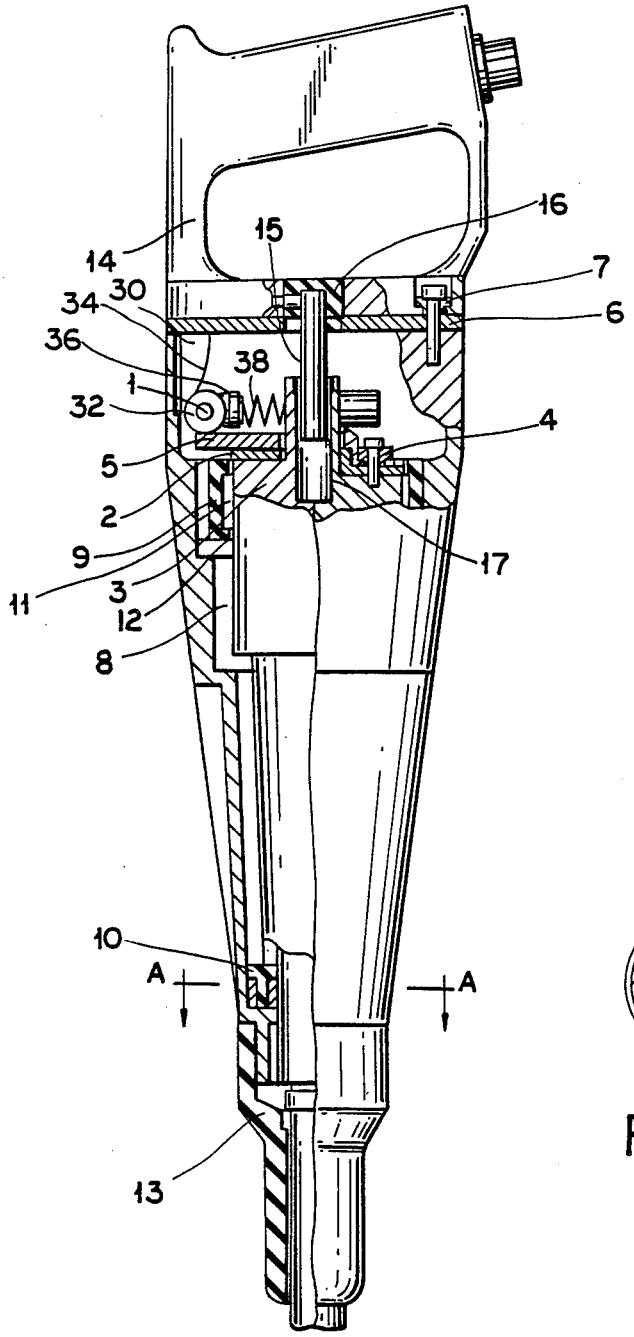
FIG. 1 is a side elevation partly broken away to show different cross-sectional views of the tool; the cross-sectional view to the left of the elongated axis of the tool being perpendicular to the cross-sectional views to the right of the axis.
Figure 2:
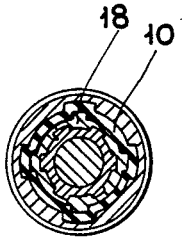
FIG. 2 is the section A—A of FIG. 1.

Vibro-isolation of connections of structural units of tools has been effected for the three various directions x, y and z. In the main direction z there has been introduced a constant interaction force vibro-isolator 1 of known type (see, for example, Polish Patent 121,231 dated Oct. 31, 1983). Because such a vibro-isolator is generally known, only a portion thereof is shown in FIG. 1, primarily for the purpose of showing how the vibro-isolator is incorporated within the tool. To the extent illustrated, the vibro-isolator includes a cam 30 mounted on an inner wall of the tool body-housing 8, a pressure roller 32 which rests against the curved surface 34 of the cam 30, and a yoke 36 pressed against the roller 32 by means of a spring 38 contained within the yoke 36, all of these elements being mounted on a guide 5. A complete vibro-isolator, as shown in the aforementioned Polish Patent, includes a cooperating additional set of cams, rollers and springs not illustrated herein. As known, the presence of the vibro-isolator is effective to interconnect two structural members while transmitting a constant force therebetween independent of the deflection of the vibro-isolator in response to forces acting on it from one of the interconnected members.

In accordance with this invention, the known vibro-isolator 1 is separated by a spring washer /2/ from the body /3/ of the compressed air engine, as well as spring washers-sleeves 4, used in order to ensure full vibro-isolation of the guide 5 of vibro-isolator 1. Similarly, on the side of the grip 14 there are fixed spring washers disposed around the screws (only one shown) securing the grip 14 to the body-housing 8 6 and spring sleeves 7 disposed around the screws (only one shown) securing the guide 5 of the vibro-isolator 1 to the air engine 3. Vibro-isolation of the body-housing on the side of the body 3 of the compressed air engine is ensured by elastic guides 9 and 10. The upper guide 9 is the sleeve 11 made of a plastic matter having a small friction coefficient and considerable damping coefficient which is mounted in an elastic connector 12 made of rubber. The lower guide 10 is a connection of the silent-block type, which serves as vibro-isolation for the directions x, y and z and for torsional vibrations. The guide 10 has a sleeve with a shaped splined slidable connection with the body 3 of the compressed air engine which enables torques to be transmitted from the body-housing 8 on to the body 3 of the compressed air engine. Guides 9 and 10 represent the first stage of vibro-isolation on the way from the body 3 of the compressed-air engine to the grips for the operator's hands. The second stage of vibro-isolation for the operator's left hand is an elastic sleeve 13 made of a material having a considerable coefficient of damping screwed onto the body-housing 3 by means of a spring embedded in the elastic sleeve 13. For the operator's right hand, that is grip 14, the third stage of vibro-isolation represents the spring washer 6 and the elastic sleeves 7. Moreover, a two-stage vibro-isolation for the supply system has been provided. The first vibro-isolation stage represents intermediate sleeve 17 made of a material having a considerable damping coefficient mounted in the body 3 of the compressed air engine. The second stage of vibro-isolation is the elastic sleeve 16 by means of which the supply tube 15 is mounted elastically in the tool grip 14. The supply tube 15 extends downwardly from the grip 14 and into the intermediate sleeve 17 for admitting air into the air engine.

We claim:

1. In a compressed-air driven hand tool comprising an elongated body-housing (8), a compressed air engine (3) disposed within said body-housing, a first grip (14) for holding the tool, and a constant interaction force vibro-isolator (1) of the type comprising roller springs biased against cams, said vibro-isolator being disposed between and interconnecting said air engine to said first grip, the improvement wherein said vibro-isolator (1) is connected to said air engine by means of a spring washer (2) disposed therebetween and interconnecting screws, elastic sleeves (4) being disposed around said screws, and said vibro-isolator (1) is connected to said first grip (14) by means of a spring washer (6) disposed therebetween and interconnecting screws, elastic sleeves (7) being disposed around said screws, said above-mentioned vibro-isolator connecting and securing means providing improved vibro-isolation between said first grip and said air engine for air engine vibrations in the direction of elongation of said body-housing, elastic guides (9 and 10) disposed between said body-housing and upper and lower portions, respectively, of said air engine allowing sliding of said engine relative to said body-housing for providing vibro-isolation between said air engine and said body housing, a second grip (13) comprising an elastic sleeve screwed onto a lower portion of said body-housing, and means for introducing compressed air into said air engine, said means comprising a sleeve (17) extending into said air engine and a tubing (15) slidably extending into said sleeve, said tubing extending through said first grip and being secured therewithin by means of a silent-block connection (16) for providing vibro-isolation between said air engine and said first grip.

2. In a tool as in claim 1, the further improvement wherein the upper one (9) of said guides comprises a sleeve (11) of a material having a small coefficient of friction and a considerable coefficient of damping, said sleeve being compressed in said body-housing by a silent-block connection.

3. In a tool as in claim 1, the improvement wherein the lower (10) one of said guides comprises a sleeve (18) disposed around said lower portion of said air engine, said sleeve being provided with internal splines meshed with splines extending from said air engine, said lower guide providing a silent-block interconnection between said air engine and said body-housing effective for providing vibro-isolation between said body-housing and said air engine for torsional vibrations from said engine.

* * * * *